US009080777B2

(12) United States Patent
Schwank et al.

(10) Patent No.: US 9,080,777 B2
(45) Date of Patent: Jul. 14, 2015

(54) REFLECTOR FOR RADIANT TUBE HEATER

(75) Inventors: Bernd Schwank, Cologne (DE); Samer Hassan, Mississauga (CA)

(73) Assignee: SCHWANK, LTD., Mississauga, Ontario (CA)

( * ) Notice: Subject to any disclaimer, the term of this patent is extended or adjusted under 35 U.S.C. 154(b) by 377 days.

(21) Appl. No.: 13/362,880

(22) Filed: Jan. 31, 2012

(65) Prior Publication Data

US 2013/0192590 A1 Aug. 1, 2013

(51) Int. Cl.
*F23C 3/00* (2006.01)
*F24C 15/22* (2006.01)
*F24C 3/04* (2006.01)

(52) U.S. Cl.
CPC ..... *F24C 15/22* (2013.01); *F24C 3/042* (2013.01)

(58) Field of Classification Search
CPC ..... F23C 3/002; F23D 14/12; F23D 2900/14121; F24C 15/22
USPC ..... 126/91 A, 92 B
See application file for complete search history.

(56) References Cited

U.S. PATENT DOCUMENTS

| | | | | |
|---|---|---|---|---|
| 2,439,038 | A | 4/1948 | Cartter | |
| 3,187,740 | A | 6/1965 | Jones et al. | |
| 3,733,461 | A * | 5/1973 | Rohats | 392/423 |
| 4,319,125 | A | 3/1982 | Prince | |
| 4,388,675 | A | 6/1983 | Lewin | |
| 4,674,016 | A | 6/1987 | Gallagher | |
| 4,676,222 | A | 6/1987 | Jones et al. | |
| 4,727,854 | A | 3/1988 | Johnson | |
| 5,224,542 | A | 7/1993 | Hemsath | |
| 5,353,986 | A | 10/1994 | Wortman et al. | |
| 5,429,112 | A | 7/1995 | Rozzi | |
| 5,626,125 | A * | 5/1997 | Eaves | 126/91 A |
| 5,945,057 | A | 8/1999 | Sellers et al. | |
| 5,975,887 | A | 11/1999 | Kamal et al. | |

(Continued)

FOREIGN PATENT DOCUMENTS

| | | |
|---|---|---|
| EP | 0332081 A2 | 9/1989 |
| EP | 0391818 A1 | 10/1990 |

(Continued)

OTHER PUBLICATIONS

TechData Sheet, Naval Facilities Engineering Service Center, Infrared Radiant Heating, May 1996, Port Hueneme, California (5 pages).

(Continued)

*Primary Examiner* — Jorge Pereiro
(74) *Attorney, Agent, or Firm* — Gifford, Krass, Sprinkle, Anderson & Citkowski, P.C.

(57) ABSTRACT

A reflector for an elongate radiant tube heater having a tubular conduit through which hot combustion gases flow comprises an elongate metal reflecting member that can extend along the length of the tube heater in order to cover the top and sides thereof and a layer of heat resistant insulation extending over the reflecting member. The reflector includes two central panel portions meeting along the longitudinal centerline and forming an outwardly facing angle ranging between 30 and 100 degrees, preferably between 45 and 80 degrees. A bisector of this angle extends substantially vertically and is vertically aligned with a centerline of the tubular conduit during use of the reflector. The reflector has several longitudinal panel sections extending outwardly and downwardly from the central panel portions.

3 Claims, 10 Drawing Sheets

(56) References Cited

U.S. PATENT DOCUMENTS

| | | | | |
|---|---|---|---|---|
| 6,092,913 | A | 7/2000 | Edwards, Jr. | |
| RE37,636 | E | 4/2002 | Wortman et al. | |
| 6,394,796 | B1 | 5/2002 | Smith | |
| 6,718,968 | B2 | 4/2004 | Cooley et al. | |
| 6,786,422 | B1 | 9/2004 | Wortman et al. | |
| 6,815,636 | B2 | 11/2004 | Chung et al. | |
| 6,988,816 | B2 | 1/2006 | Witkowski | |
| 7,011,516 | B2 | 3/2006 | Aust et al. | |
| 7,793,683 | B2 | 9/2010 | Noble et al. | |
| 7,874,835 | B2 * | 1/2011 | Schwank et al. | 431/354 |
| 7,913,683 | B2 | 3/2011 | Schwank et al. | |
| 2005/0266362 | A1 | 12/2005 | Stone et al. | |
| 2006/0169275 | A1 | 8/2006 | Murdoch | |
| 2009/0064869 | A1 | 3/2009 | Shealy et al. | |
| 2009/0241943 | A1 | 10/2009 | Schwank et al. | |
| 2011/0049253 | A1 * | 3/2011 | Catteau et al. | 237/56 |

FOREIGN PATENT DOCUMENTS

| | | | |
|---|---|---|---|
| GB | 2161348 | A | 1/1986 |
| WO | 9709569 | A1 | 3/1997 |

OTHER PUBLICATIONS

Schwank Ltd., Roberts Inner reflector, Mar. 2011.
Schwank Ltd., Detroit Inner reflector, Mar. 2011.

* cited by examiner

REFLECTOR FOR RADIANT TUBE HEATER

BACKGROUND OF THE INVENTION

This invention relates to radiant tube heater systems and in particular to reflectors for radiant tube heaters.

Radiant tube heater systems are well known in the heating industry and are useful for warming large covered spaces such as those found at industrial and manufacturing facilities, air craft hangers and swimming pools. However there are some known and perceived problems with such heating systems including insufficient heat being supplied to areas in which heat is needed and the non-uniform supply of heat to areas along the length of the tubular conduit through which the combustion gases flow.

It is known to provide metal reflectors located directly above the radiant tube and extending the length thereof in order to reflect the heat from the tube downwardly towards the floor area of the building or structure where it is required. A low intensity tube heater generally comprises a burner attached to a steel radiant tube. The sheet metal reflector extends over the top of the tube and also over its two opposite sides. The reflector re-radiates and re-directs infrared heat energy back to the tube, to the floor and to itself and, in this way, it reduces convection losses and directs more radiant heat to the ground or floor where it is needed.

Most known low intensity infrared heaters have a radiant factor of 40% to 45% and a convection heat output of 35% to 40%. Traditional radiant tube systems have an inability to effectively control the convection and radiant outputs. Radiant tube heaters for commercial and industrial space heating systems can have a variety of firing rates ranging from, for example, 45,000 BTU/H to 200,000 BTU/H.

There is a need for better, more efficient radiant tube heaters having an increased radiant factor and an improved heat flux density on the floor area. By improving the efficiency of a radiant tube heater of the aforementioned type, it is possible to reduce fuel consumption while still achieving a comfortable temperature level and it is also is possible to reduce carbon emissions.

SUMMARY OF THE PRESENT DISCLOSURE

According to one embodiment of the present disclosure a reflector for an elongate radiant tube heater having a single tubular conduit through which hot fluid in the form of combustion gases flow comprises an elongate metal reflecting member adapted to extend along the length of the tube heater and to cover the top and two opposite sides of the tube heater in order to reflect and disperse radiant heat waves from the tubular conduit. The reflecting member includes two central panel portions meeting along a longitudinal centerline of the reflecting member and forming an outwardly facing angle ranging between 30 and 100 degrees. A bisector of the angle extends substantially vertically and is vertically aligned with a centerline of the tubular conduit during use of the reflector on the radiant tube heater. The reflecting member has further longitudinal panel sections extending outwardly and downwardly from the central panel portions. The reflector includes a layer of heat resistance insulation extending over an outer surface of the reflecting member.

According to an exemplary version of the aforementioned reflector, the outwardly facing angle formed by the central panel sections ranges between 45 and 80 degrees.

According to a second embodiment of the present disclosure, a radiant heating apparatus for attachment to a burner for burning a heating fuel to produce combustion gases includes an elongate tubular conduit through which the combustion gases can flow and burn, one end of the conduit being connectable to an outlet of the burner. An insulated reflector extends lengthwise along the tubular conduit and is positioned and shaped to reflect and disperse radiant heat waves from the conduit during use of the apparatus. The reflector has a longitudinal centerline located above and spaced from the tubular conduit. The centerline divides the reflector into two half sections. Each half section is formed with at least three longitudinal bends located between the centerline and a respective bottom edge of the half section and dividing the half section into at least four longitudinal reflecting portions including a central portion. This central portion slopes upwardly from the centerline during use of the heating apparatus. The central portions of the two half sections form a central angle ranging between 30 and 80 degrees, this angle facing away from the tubular conduit.

In an exemplary version of the aforementioned heating apparatus, the reflective portions of each half section include a second reflecting portion adjacent a respective one of the central portions and forming a second angle in a transverse plane ranging between 100 and 135 degrees and facing inwardly in the direction of the tubular conduit.

According to a third embodiment of the present disclosure a radiant tube heater system comprises a single tubular conduit through which hot fluid including combustion gases flow and a plurality of support structures for supporting the conduit at spaced locations along its length. The combustion gases flow from one end to another end during use of the heater. An insulated reflector extends lengthwise along the tubular conduit and is constructed and shaped to reflect and disperse radiant heat waves from the conduit. The reflector has a first longitudinal centerline located above a second longitudinal centerline of the conduit. The first longitudinal centerline divides the reflector into two similar half sections extending in opposite transverse directions from the centerline. Each half section is formed with three longitudinal bends which form obtuse angle facing inwardly towards the conduit. The bends of each half section divide the half section into longitudinal reflecting portions including a central portion that slopes upwardly from the first longitudinal centerline during use of the heater system. The central portions of the two half sections form an outwardly facing angle ranging between 30 and 100 degrees.

In one exemplary form of this tube heater system, the outwardly facing angle is approximately 60 degrees and the reflector is constructed of bent metal sheet and is insulated with ceramic insulation extending over the outer surface of the reflector.

These and other aspects of the disclosed reflectors and radiant tube heater systems will become more readily apparent to those having ordinary skill in the art from the following detailed description taken in conjunction with the drawings.

So that those having ordinary skill in the art to which the present disclosure pertains will more readily understand how to make the subject invention, exemplary embodiments thereof will be described in detail herein below with reference to the drawings, wherein:

DETAILED DESCRIPTION OF EXEMPLARY EMBODIMENTS

Figure 1:
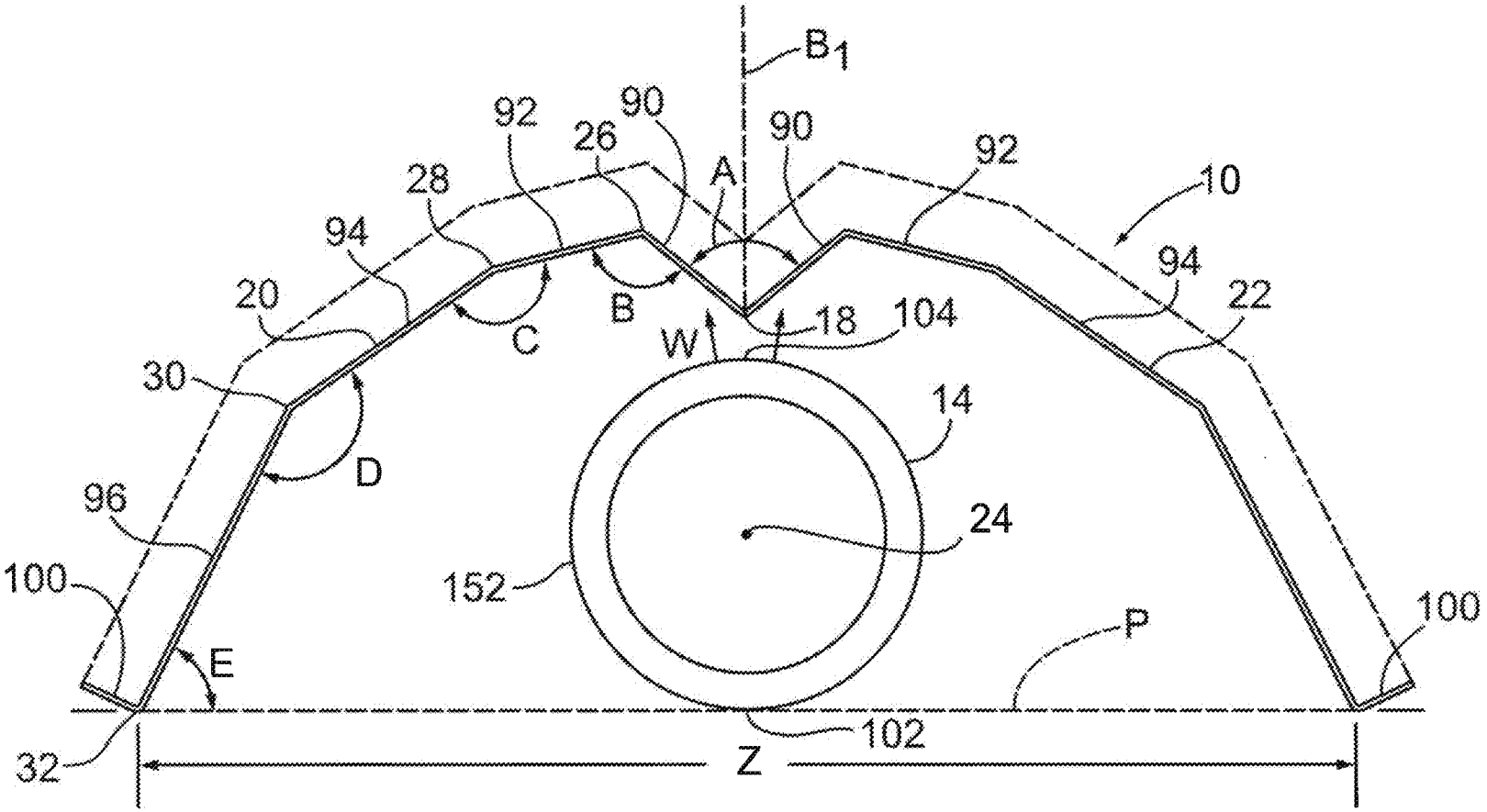
FIG. 1 is a transverse, vertical cross-section of a reflector for a radiant tube heater constructed in accordance with the invention, this view also showing a radiant tube positioned within the reflector.
Figure 2:
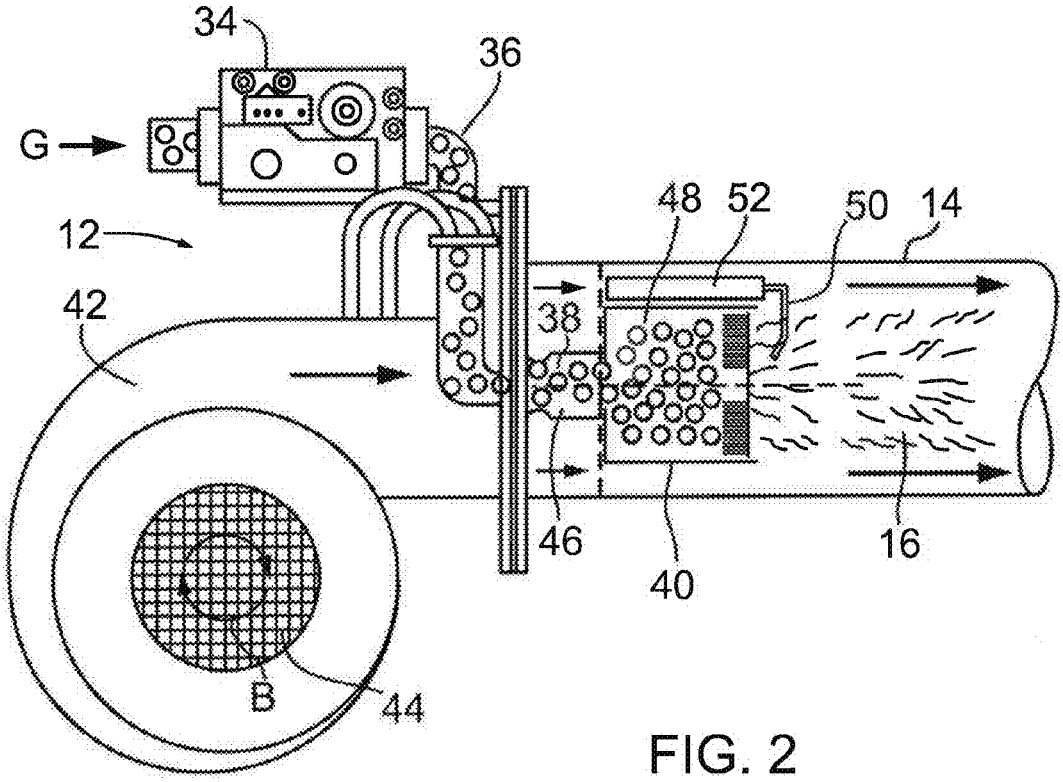
FIG. 2 is a schematic cross-sectional view of a radiant tube heater in use, this view showing an elongate laminar flame extending from a burner head, a major portion of the radiant tube being omitted along with its reflector for purposes of this illustration.

Shown in FIG. 1 is a transverse vertical cross-section of a reflector 10 for an elongate radiant tube heater such as the heater 12 illustrated schematically in FIG. 2 which does not show the reflector extending above and around the two opposite sides of its radiant tube 14. The tube 14 is an elongate tubular conduit through which hot fluid in the form of combustion gases flow, these gases being indicated at 16. The reflector is insulated with a heat resistant layer of insulating material. This insulating material can withstand the high temperatures produced by the radiant tube. The reflector includes an elongate, metal reflecting member adapted to extend along the length of the radiant tube 14 in order to reflect and disperse radiant heat waves from the radiant tube. The reflector has a longitudinal centerline which can be referred to as a first longitudinal centerline 18 that divides the reflector into two similar half sections 20 and 22. These half sections extend in opposite transverse directions from the longitudinal centerline 18 which is in normal use located above the longitudinal centerline 24 of the radiant tube 14. This centerline may be identified as the second longitudinal centerline of the radiant tube heater. In the illustrated exemplary embodiment each half section of the reflector is formed with several longitudinal bends each of which forms an obtuse angle facing inwardly towards the tubular conduit. In the half section 20, these bends are indicated at 26, 28 and 30. In addition to these bends, there is a central bend where the two half sections meet. This bend is at the centerline 18.

Optionally, in an exemplary embodiment there is a further bend 32 located at each of the two bottom ends of the half sections. The illustrated bend 32 forms a 90 degree angle, this angle facing generally upwardly and outwardly. The exemplary reflector is made of a highly reflective metal, at least on its inner reflecting surface, two suitable metals being aluminized steel sheet metal and Feran.

A standard exterior diameter of the radiant tube is four inches and the length of the tube varies depending upon the particular job requirements but can arrange for example from 25 to 70 ft or more.

With reference now to FIG. 2, this figure illustrates a radiant tube heater constructing in accordance with U.S. Pat. No. 7,931,683 dated Mar. 29, 2011, the description and drawings of which are incorporated herein by reference. In FIG. 2 only an upstream portion of the radiant tube 14 is shown for ease of illustration. The radiant tube can comprise several sections arranged end to end as is well known to those skilled in the heating art. The tube is heated by the flame and combustion gases to emit infrared radiant heat which is reflected downwardly to the floor area or objects below the heater by the reflector 10. Shown in FIG. 2 is a gas valve governor or gas valve unit 34 for the heater which connects to one end of a gas pipe 36. This pipe extends to a burner nozzle 38 and a burner head 40 mounted on the nozzle. The heater system also includes a blower or blower fan 42 having a side air inlet 44 into which external air is drawn. The blower has an outlet section which extends tangentially relative to the blower fan and which is connected to the upstream end of the radiant tube or tubular conduit 14.

The burner head 40 is mounted within the tube and is adapted for mixing combustible gas and for delivering the resulting mixture into an upstream end section of the tubular conduit as shown. The burner head is generally annular and has a cylindrical inlet portion 46 and a wider cylindrical outlet portion 48. The heater can be provided with natural gas or LPG gas indicated by the arrow G taken from a suitable source and delivered through the gas valve unit 34. Combustion air enters through vents or pores distributed about the periphery of inlet portion 46. The mixture exiting from the burner head 40 is ignited by an ionization electrode 50 so as to produce a long laminar flame that extends substantially the length of the radiant tube. The preferred material for the radiant tube 14 is stainless steel or aluminized steel, at least for an upstream section thereof that surrounds the hottest part of the flame and the burner head. The remaining downstream section can be cold rolled steel.

Figure 6:
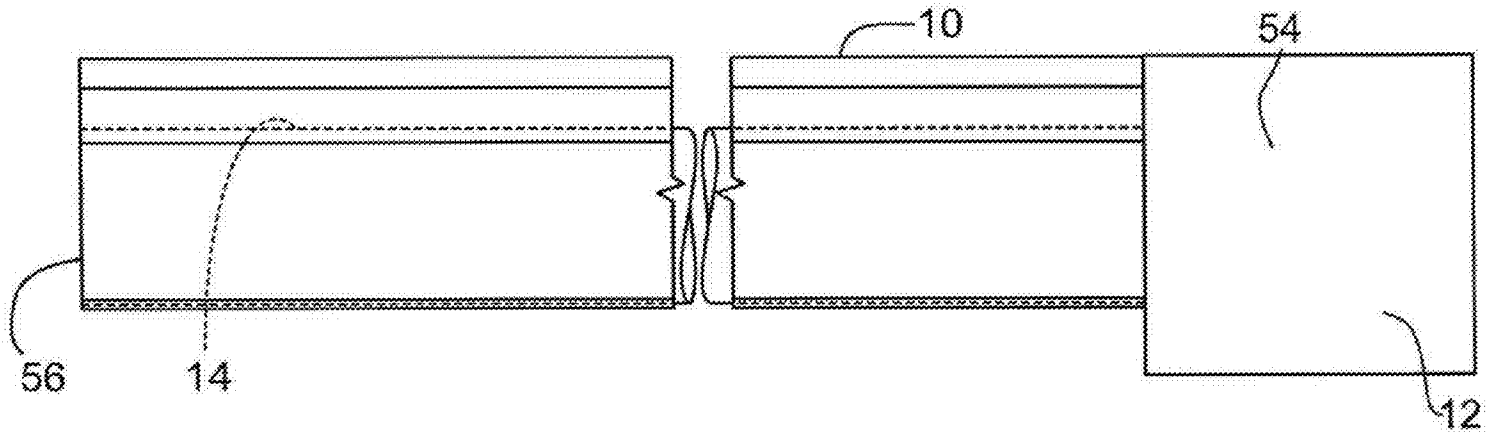
FIG. 6 is a side elevation of the reflector and radiant tube of FIG. 1 mounted over a floor area.
Figure 6:
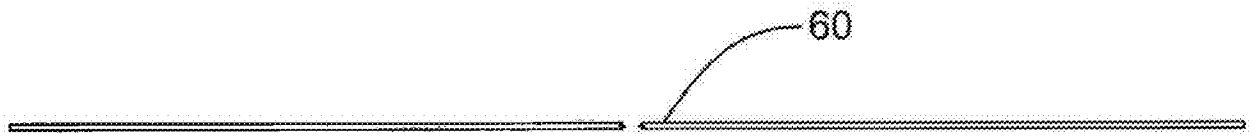

FIG. 6 schematically illustrates a radiant tube heater system indicated generally by reference 54. FIG. 6 illustrates how the reflector 10 extends along the length of the radiant tube 14. Located at the upstream end of this tube is the aforementioned heater 12. It will be appreciated that exhaust gases exit through the downstream end 56 of the tube through a suitable exhaust pipe which can deliver the gases to atmosphere. The radiant tube heater is designed and constructed to provide heat to a generally rectangular floor area indicated at 60. This floor area can, for example, be the floor of and industrial or commercial facility, usually a facility having a relatively high ceiling which may render other forms of heating impractical or inefficient.

Figure 3:
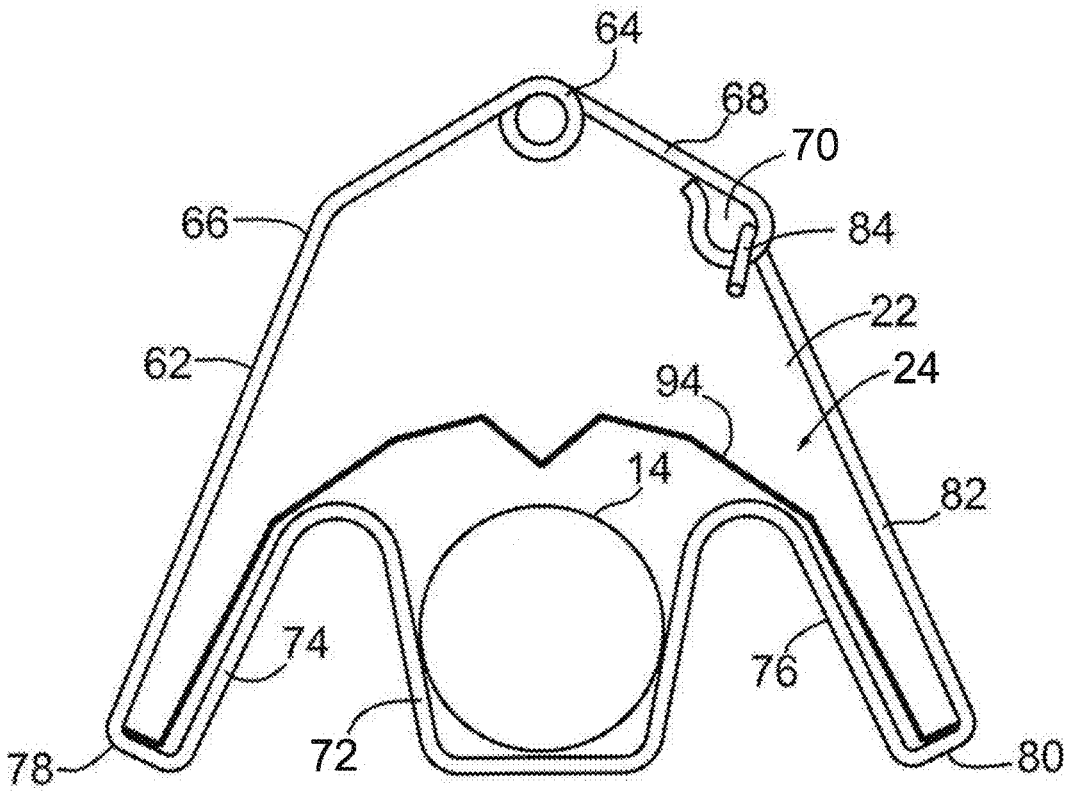
FIG. 3 is a transverse vertical cross-section of the reflector and radiant tube of FIG. 1 showing a hanger used to support both the reflector and the tube.

Both the radiant tube and its reflector 10 can be hung from a ceiling or roof trusses with the use of a series of hangers 62, one of which is illustrated in FIG. 3. These hangers can be made from bent metal rods or wires in a manner known per se. The illustrated hanger 62 has a central, top loop 64 which can be attached to the end of a chain or hanging wire extending from the ceiling. Sloping downwardly from opposite sides of the center loop are a bent arm 66 and a shorter arm 68 which forms an end loop at 70. The hanger includes a bottom section which has a substantially U-shaped central portion 72 sized to receive the radiant tube 14 as shown. The bottom section of the hanger also includes two bent connecting sections 74, 76 that are integrally connected to the central portion 72 and that extend respectively to bottom ends of the hanger. The two bottom ends 78, 80 of the hanger are sized and adapted to support the two bottom edges of the reflector as shown. Extending upwardly from the bottom edge 80 is a resilient end section 82 which has a hook 84 at its upper end. After the hanger is mounted around both the tube and the reflector, the hook 84 is inserted through the end loop 70 so that the hanger forms a complete loop able to support the tube and the reflector from a ceiling or roof of a building or other structure.

In order to develop an improved, efficient reflector for a radiant tube heater, a method has been developed for accurately measuring the heat flux from a radiant tube heater at floor level using a special water-cooled heat sensor. This sensor, its method of cooling and the measuring method for determining the heat flux along the length of a radiant tube heater are explained hereinafter. Using these accurate measurements of heat flux emitted by a radiant tube heater and computational fluid dynamics (CFD) a substantially improved reflector for a radiant tube heater has been developed and one embodiment is illustrated in FIG. 1. An important aspect of this reflector is the central outwardly facing angle indicated at A. Each half section of the reflector includes a central reflecting portion that slopes upwardly from the first longitudinal centerline 18 during the use of the heater system. The angle A formed by the central portions of the reflector ranges between 30 and 100 degrees. A particular exemplary range for the outwardly facing angle A is between 45 and 80 degrees and in one particular exemplary embodiment, the angle A is approximately 60 degrees. It will be appreciated that with the central reflecting portions 90 extending at the indicated angle to the horizontal plane, they effectively reflect and radiate the heat waves indicated by the arrows W that are radiating from the top of the radiant tube. Instead of being reflected back towards the radiant tube, they are to an extent either reflected downwardly towards the floor area or towards one of the outer reflecting portions of the reflector.

In the exemplary illustrated reflector, there are the aforementioned three bends 26, 28 and 30 formed in each half section. Located adjacent to the central portion 90 is a second reflecting portion 92. Adjacent this second longitudinal portion and located outwardly there from is a third reflecting portion 94 which, as shown, can be wider than the second reflecting portion. Furthermore adjacent the third reflecting portion and sloping outwardly and downwardly therefrom is a fourth reflecting portion 96 which extends to one bottom edge of the reflector. The first longitudinal bend 26 is formed between its respective central portion 90 and the adjacent second portion 92. The second longitudinal bend is formed between the second reflecting portion 92 and the third reflecting portion 94 while the third longitudinal bend is formed between the third reflecting portion 94 and the fourth reflecting portion 96. In an exemplary version of the reflector, the size of the inner angle at the first longitudinal bend 26 is at least 110. In an exemplary version of the reflector, the inwardly facing angle B ranges between 105 and 140 degrees. Each of the angles at B, C and D are dependent to a degree on the width of the adjacent reflecting portions of the half section. The inner angle C at the second longitudinal bend 28 in the exemplary reflector is at least 150 degrees and in the illustrated exemplary embodiment is 160 degrees. In an exemplary version of the reflector, the angle C ranges between 150 and 170 degrees, the angle C being the angle facing inwardly in the direction of the tubular conduit or radiant tube. In one particular exemplary embodiment of the reflector illustrated in FIG. 1, the width of the central reflecting portion 90 on each half section is 1.42 inches while the width of the second reflecting portion 92 is 1.77 inches. Also in this embodiment the width of the third reflecting portion 94 is 2.83 inches while the width of the fourth reflection portion 96 is substantially larger at 3.9 inches. The overall width of the open bottom of the reflector indicated by Z in FIG. 1 in this exemplary embodiment is 14.18 inches. Radiant tube heaters in general are known to have a radiant tube having an external diameter of about four inches and a reflector that ranges in width between 12 and 15 inches.

Turning to the inner angle D formed between the third reflecting portion 94 and the fourth reflecting portion 96 and located in a transverse plane relative to the longitudinal center axis of the radiant tube, an exemplary range for this angle is between 140 and 160 degrees and the illustrated exemplary angle D is 150 degrees. The angle E formed between the horizontal plane and the fourth reflecting portion 96 can vary and depends to a degree on the size of the angles B, C and D. Typically this angle is about 65 degrees. If desired, a short edge flange 100 can be provided along the two opposite longitudinal bottom edges of the reflector. One function of these flanges is to avoid a sharp metal edge at the bottom edges of the reflector thereby making it easier to handle and install.

Although the width of each of the reflecting portions that extends longitudinally along each half section can vary to a degree, based on the diameter of the radiant tube being about 4 inches, an exemplary version of the reflector 10 has a central reflecting portion 90 with a transverse width of at least 1.3 inches while the transverse width of each of the second and third reflecting portions 92, 94 is at least 1.70 inches.

As illustrated in FIG. 1, during normal use of the present reflector over a radiant tube which extends horizontally, a bisector of the angle A indicated by the line B1 extends in a vertical plane extending along the centerline of the radiant tube. Thus the bisector B1 is vertically aligned with the longitudinal centerline 24 of the tubular conduit.

In general, it is preferred that the radiant tube 14 be not only covered by the reflector over its top side but also on the vertically extending sides of the tube as shown. The illustrated tube heater 14 has a bottom or bottom extremity at 102 and this bottom is aligned approximately with a horizontal plane indicated at P defined by the two opposite bottom edges of the reflector. In the illustrated reflector these bottom edges are formed by the reflector bends at 32. Also shown in FIG. 1 is a gap or space between the top or top extremity 104 of the tube and the longitudinal centerline 18 of the reflector. In an exemplary embodiment this gap is about 0.6 inches.

The improved reflector for a radiant tube heater described above is able to provide a better radiant factor based on net calorific value. The reflector for the radiant tube heater has an effect on the radiant factor on the basis of the following factors:

1) Shape and construction of the reflector shield including the central bend angle at 18;
2) The material from which the reflector is made, for example a highly polished metal such as Feran reflects more radiant heat to the ground or floor;
3) Reflector coverage area around the radiant tube; and
4) Insulation used on the reflector.

As far as insulation is concerned, the insulation that can be used on the present reflector is a layer of ceramic insulation that extends over the outer surface of the reflector and that is able to withstand the relatively high temperatures created at the reflector by the radiant tube heater, including the highest temperatures generated along the length of the tube.

Measuring Heat Flux Generated By Radiant Tube Heater with Reflector

Figure 4:
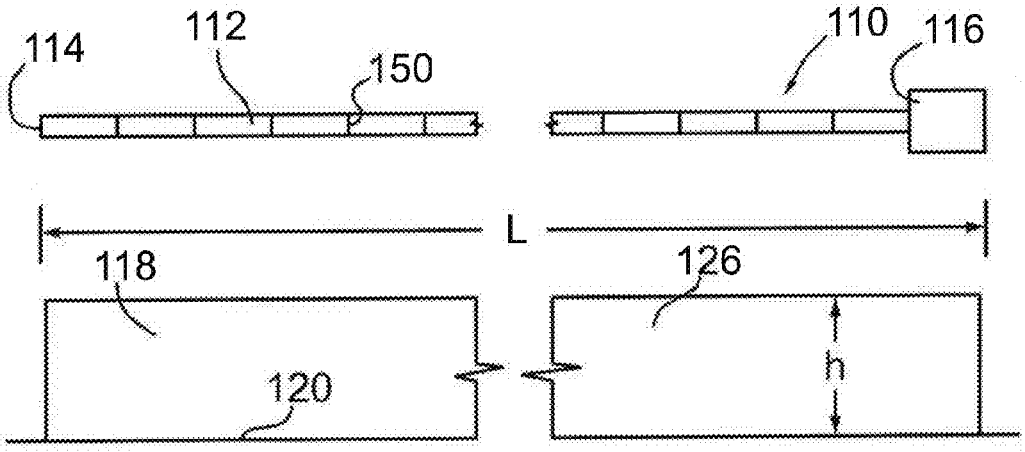
FIG. 4 is a schematic elevation showing a radiant tube heater mounted above a floor and a rectangular enclosure used for measuring heat flux at floor level, central portions of both the radiant tube and the enclosure being omitted.
Figure 5:
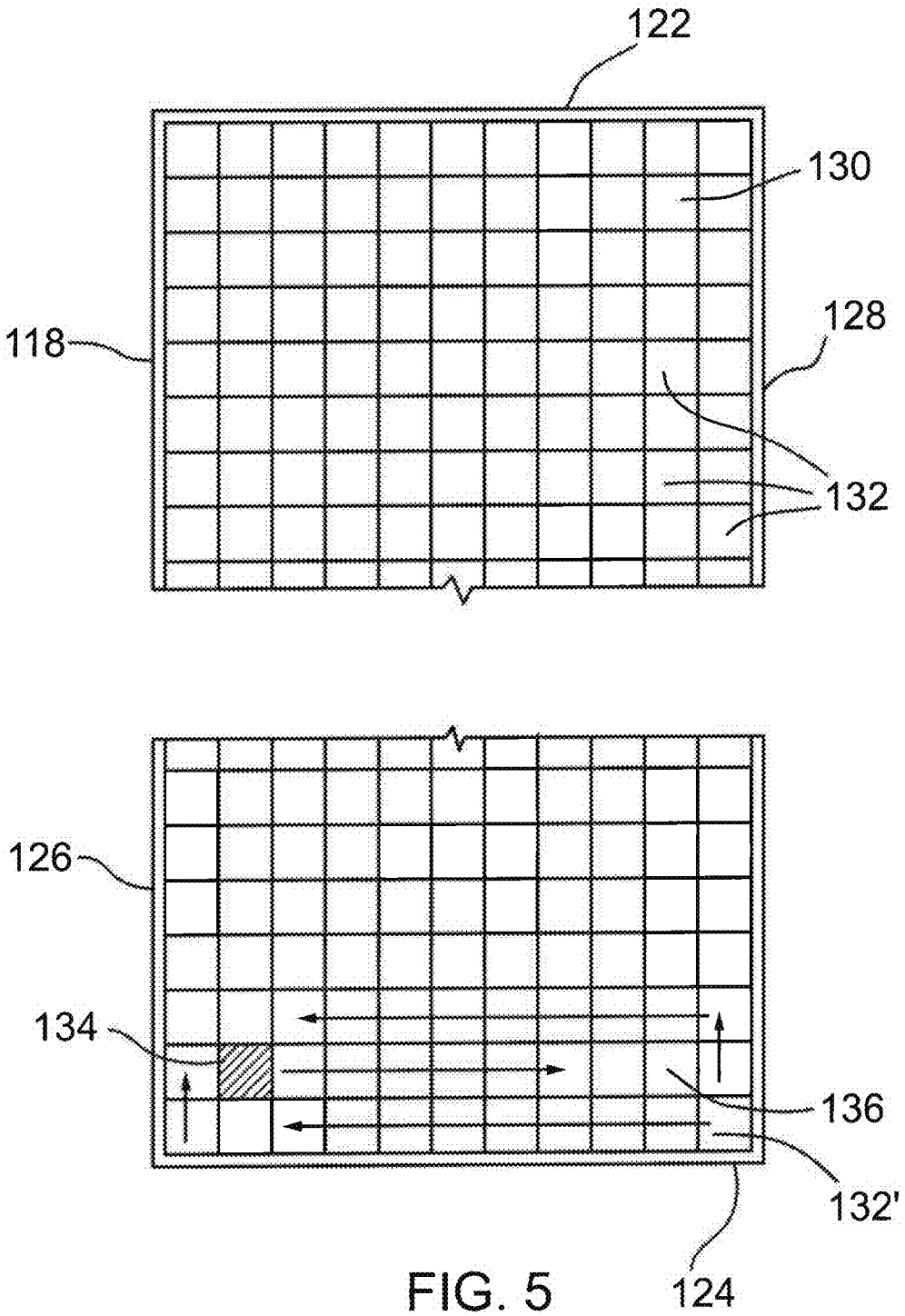
FIG. 5 is a schematic plan view of the enclosure of FIG. 4 showing a grid of side-by-side squares drawn or otherwise formed on the floor area.
Figure 8:
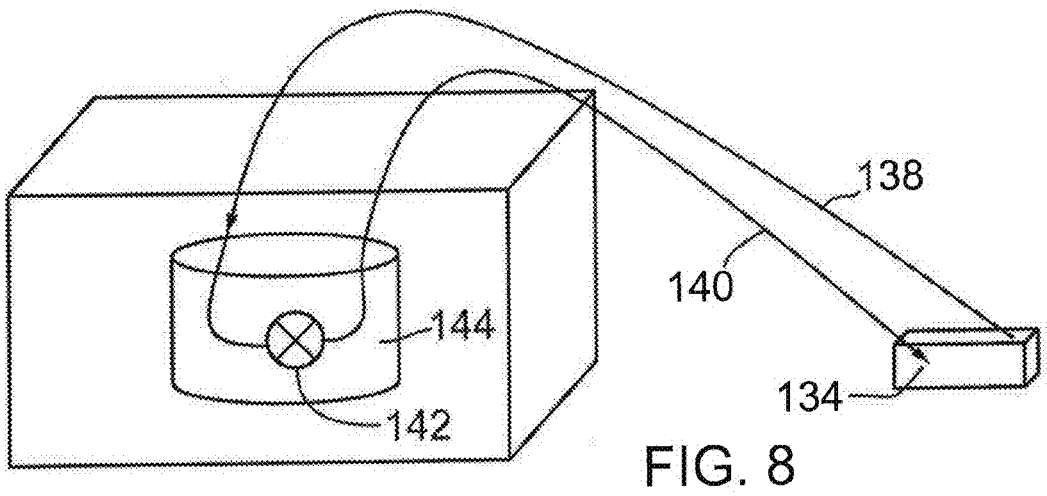
FIG. 8 is a schematic perspective view illustrating a water cooling system for a heat flux sensor used to measure heat flux on the floor area.

In order to develop and test the above described, improved reflector for a radiant tube heater, it was necessary to develop an accurate system and method for measuring the heat flux generated by the radiant tube heater at floor level. FIGS. 4, 5 and 8 illustrate schematically a new system and method for measuring heat flux from such a heater using a heat flux sensor, the temperature of which can be carefully controlled during the measurement process. In addition this new method measures the surface tube temperatures accurately across and along the radiant tube heater at regular intervals along the radiant tube. With reference to FIG. 4, there is shown a radiant tube heater system indicated generally at 110 and shown without the reflector of the invention for illustration purposes. This system includes an elongate radiant tube 112 having a distal end at 114 and a natural gas burner and blower combination 116 at an upstream end. The radiant tube is shown as having indefinite length and can, for example, be 30 ft., 50 ft. or 70 ft. in length. Although the hangers are not shown, it will be understood that the radiant tube heater including the combination burner/blower are suspended from a ceiling of the building in which the heat flux measurements are carried out. Extending the length of the radiant tube 112 and arranged on the floor of the building is a test enclosure 118. The floor 120 on which the enclosure rests can be a finished concrete floor like that found in many industrial buildings. The length of the enclosure indicated at L can correspond substantially to the length of the radiant tube but it can also be shorter than the tube (extending only below the hotter sections of the tube). In one set of experiments conducted by the applicants, the radiant tube measured 50 ft. in length as did the distance L of the enclosure and the horizontal width of the enclosure was 65 inches but the width of the heat flux measuring area can be extended if desired. The enclosure has two end walls indicated at 122 and 124 in FIG. 5 and two long side walls 126, 128. The height of these walls can vary but, in the exemplary measuring system used by the applicants the height was about 3 ft. The enclosure walls were made of cardboard panels but other materials such as wood or plastic panels could also be used. The function of the enclosure is to prevent undesirable air currents in the region of the floor that is surrounded by the enclosure. These currents could be caused by persons walking near to measurement area for example. Although the height could be somewhat higher than 3 feet, it should not be too high as the heat generated by the tube heater must be able to escape from the enclosed area.

The rectangular measurement plane indicated at 130 was divided into a grid of squares arranged side by side and drawn or painted on the measurement area. These measurement squares are indicated at 132. The actual size of these squares is dependent upon the horizontal measurements of the heat sensor used for the heat flux measurements, this substantially square sensor being indicated at 134 in FIG. 5. The particular sensor used by the applicants was a type GHT-1C geothermal heat flux transducer available from International Thermal Instrument Company of Delmar, Calif. and its horizontal measurements are 6 inches by 6.5 inches and the sensor has a standard height of 0.225 inch. As explained hereinafter, the sensor is modified to provide for water cooling of the sensor. In order to measure the heat flux over the entire measurement plane 130, it was necessary to move the sensor 134 sequentially from one square to the next beginning, for example at the measurement square 132' in one corner of the plane. The arrows at the bottom of FIG. 5 illustrate how the sensor was moved transversely across the measurement plane from the corner square and then, after heat flux measurements have been taken at each square in the row, the sensor is moved up to the adjacent transverse row indicated at 136.

The exemplary heat sensor that was used has a range of 1 millivolt to 1,200 millivolts and measures the local heat flux in one direction with the results being expressed in watts per square meter. The sensitivity of the sensor 134 that was used is 1.1 watts/$m^2$ per 1 MV and it operates in temperatures ranging from −100° F. to 250° F. The DC signal generated by the transducer is conducted to the readout instrument by means of a waterproof cable. Upon obtaining thermal equilibrium with its surroundings, the sensor develops a voltage which is directly proportional to the local heat flux. The principle of operation of this exemplary sensor is that the flow of heat through the transducer creates a minute temperature difference between its surfaces. A multi-element, semi-conductor thermopile consisting of hundreds of Bi/Te elements generates a DC voltage via the Seebeck effect. The resulting signal is directly proportional to the heat flux through the transducer.

Although initial heat flux measurements were taken by placing the sensor directly on the floor, it was found that the millivolts readings fluctuated significantly at a selected location because the floor acts as a heat storage reservoir, and once it is heated, the floor will give off heat by radiation to the surroundings. The sensor was later tested by mounting it on a small wood panel but again some fluctuations in the readings at the selected location were observed. This difficulty was overcome by modifying the sensor so as to provide cooling by circulating water through the lower or bottom part of the sensor at a substantially constant temperature by means of a pump. In order to provide for water cooling, the aforementioned heat sensor was modified by the addition of grooves and channels adjacent its bottom side through which water can circulate. Two water nipples were added to the sensor so as to provide an inlet and outlet for the water and these nipples were attached to plastic hoses.

This set-up is illustrated schematically in FIG. 8 wherein the two hoses are indicated at 138 and 140 and a water pump is indicated at 142. The submersible pump was placed inside a small reservoir such as a pail indicated at 144. The water temperature in the reservoir was kept constant at 69° F. either by use of an ice pack or by adding cold water. The water temperature was measured carefully using 12 type K thermocouples divided into three sets of 4 thermocouples. One set was located at the bottom of the water reservoir, the second set at mid-height in the water and the third set just below the surface of the water. The four thermocouples of each set were connected in parallel and the two free ends of each couple were connected to a Fluke thermometer to read the water temperature.

For purposes of heat flux measurement, it was also necessary to measure accurately the surface tube temperature of the radiant tube heater and type K thermocouples were used for these measurements, these thermocouples being indicated at 150 In FIG. 4. There thermocouples were placed at one foot intervals along the length of the tube heater. Thus, in the case of the radiant tube having a 70 ft. length, 210 thermocouples were used. At each one foot interval, there was one thermocouple mounted at the top of the tube (indicated at 104 in FIG. 1), one thermocouple mounted at the bottom extremity of the tube (indicated at 102), and a third thermocouple was located at mid-height along one side of the tube, this position indicated at 152 in FIG. 1. The thermocouples were attached to the surface of the tube using stainless steel pipe clamps. It will be appreciated that because of driven-flame buoyancy, a radiant tube heater generally has a higher tube temperature at the top of the tube and a lower tube temperature at the bottom of the horizontal tube. Theoretically and in practice, the temperature at mid-height of the tube falls between the top surface tube temperature and the bottom surface tube temperature.

In addition to measuring the surface temperature along the length of the radiant tube, it is also necessary to measure the ambient temperature of the air in the vicinity of the tube. The ambient temperatures were monitored by three thermostats placed along the length of the radiant tube heater, namely in the region of the first tube section located adjacent the burner, the middle section and adjacent the outlet or distal end of the radiant tube. In one exemplary set up for heat flux measurements the first thermostat was positioned about three feet away from the burner and the hot end of the radiant tube, the second thermostat was located five to seven feet away from the middle of the radiant tube while the third thermostat was about three feet from the distal or outlet end of the radiant tube. The three thermostats were used to calculate an average temperature which was then used to establish a boundary condition for the CFD software simulation of the heat flux measuring process. (see below)

In order to measure the voltage induced by the heat sensor 134 at each location on the grid, a voltmeter was used. An exemplary voltmeter that can be used is a Fluke-289, a precise and calibrated voltmeter having an accuracy within 10 to 15 millivolts and a precision of 1 microvolt. The readings from this voltmeter were taken after the surface tube temperature of the radiant tube heater reached a steady state. It was found that the steady state can easily be obtained from one half to one hour from burner start up. The achievement of this steady state condition was ensured by the above described taking of measurements of the radiant tube surface temperature and checking to confirm that the measurements did not change with time. The millivolts readings were allowed to fluctuate within 2% according to the manufacturer's specifications but the readings rarely fluctuated more than 3% of the average reading's value. If the fluctuations were very large and continued for a relatively long time, the measurements were stopped and the sources of error were investigated. It was found that possible sources of error in the heat flux readings include a change of ambient temperature, people passing close to the measurement area, environmental radiation, and excessive noise in the area of the measurement squares. To eliminate the possible effect of dust and debris on the tube and reflector, a vacuum cleaner and gauze were used to clean and wipe the tube and reflector twice a week. To avoid any fouling or scaling inside the grooves/channels of the heat flux sensor 134, in the hoses or in the pump, filtered water was used and changed daily. Any windows in the measurement area were covered with shutters to avoid sunlight hitting the enclosed area.

Calculation of Heat Flux Employing CFD Software

In order to validate the heat flux measurements taken using the above described measuring method computational fluid dynamics (CFD) software was used to compute the theoretical heat flux on a floor area corresponding to that used for the actual heat flux measurements. In order to use this software a number of parameters pertaining to the tube-reflector system were determined. One of these considered as an operating variable for the computer program was the height of the RTH above the floor area which is set initially at 100 inches corresponding to the actual height of the RTH using the measurement method described above. Maximum average values of numerical simulation results of the tube-reflector assembly were determined for heights of 14 feet and 18 feet and these values are set out in Tables 1 and 2 below. In the CFD numerical study, the effects of minor parts of the RTH such as clamps, screws, wire hangers and hanger plates were eliminated. This study used seven interpolation functions (see below) each for a respective one of seven 10 foot sections of the radiant tube and generated by Table 3D Curve software and these functions were used to approximate the tube temperature along each 10 foot length. The numerical results of heat flux were calibrated with the experimental data which was affected by slight changes of ambient temperature, material emissivity, environmental radiation and local meshing settings.

The temperature of the radiant tube was taken at a steady state condition and this temperature acted and served as boundary conditions for the simulation code. Although the flow simulation software can accommodate data from a few points, because the data points were in the order of 100 or more, it was necessary to use an analytical function. The obtained data was fed into the Table 3D Curve program in order to generate the corresponding interpolation functions. The experimental readings based on the above mentioned heat flux measuring method employing a heat flux sensor were compared to the numerical results produced by the CFD software for radiant tube height at 100 inches. The comparison between the experimental data and the generated numerical values produced by the analytical functions showed a definite correlation with the correlation percentage being between 97 and 98%.

The interpolation functions for a 200K Btu/H radiant tube heater (70 foot tube length) were determined to be the following:

$$(321.38889 + 389.31365*z - 74.8053*z\text{^}2 + 6.3272*z\text{^}3 - 0.21047*z\text{^}4 + 878.08013*\text{theta} - 1176.311451*\text{theta}\text{^}2 + 396.82725*\text{theta}\text{^}3 + 32.11088*\text{theta}\text{^}4 - 21.27832*\text{theta}\text{^}5). \quad \text{Function 1}$$

$$(63152.09708 - 21477.29034*z + 2935.88384*z\text{^}2 - 198.421465*z\text{^}3 + 6.620202031*z\text{^}4 - 0.087222222*z\text{^}5 + 56.30573*\text{theta} - 5.760882794*\text{theta}\text{^}2). \quad \text{Function 2}$$

$$(1279.412121 - 39.53914141*z + 70.31847134*\text{theta} + 0.53156565656*z\text{^}2 - 3.63097894438*\text{theta}\text{^}2 - 1.08280254777*z*\text{theta}). \quad \text{Function 3}$$

$$(151787.528972015 - 17354.547916896*z + 746.039478681*z\text{^}2 - 14.233974309*z\text{^}3 + 0.101641414*z\text{^}4 + 22.292993631*\text{theta}). \quad \text{Function 4}$$

$$(91499.670070302 - 8137.9256710687*z + 273.631019897*z\text{^}2 - 4.097060320*z\text{^}3 + 0.023018648*z\text{^}4 + 20.636942675*\text{theta} - 1.014239929*\text{theta}\text{^}2). \quad \text{Function 5}$$

$$(627.8227272727 - 2.4744949495*z + 35.8656629994*\text{theta} - 0.0391414141*z\text{^}2 - 1.8864862672*\text{theta}\text{^}2 - 0.2451264235*z*\text{theta}). \quad \text{Function 6}$$

-continued $$(-434.6960678210 + 28.2928932179 * z + 94.0109695683 * \text{theta} - 0.2640692641 * z\text{^}2 - 1.8256318715 * \text{theta}\text{^}2 - 1.1093418259 * z * \text{theta}). \quad \text{Function 7}$$

Function 7:

(−434.6960678210+28.2928932179*z+94.0109695683*theta−0.2640692641*z^2−1.8256318715*theta^2−1.1093418259*z*theta).

It should be understood that function 1 is used for the first 10 ft length of the radiant tube and each of the subsequent functions is used for respective one of the following six ten foot sections of the tube.

The problem of determining leaving and net radiant heat fluxes is solved using a discrete Monte Carlo method. This numerical method solves the following radiative transfer equation (RTE) in steady state:

$$\frac{\mu \partial I_\lambda}{\partial x} + \frac{\xi \partial I_\lambda}{\partial y} + \frac{\eta \partial I_\lambda}{\partial z} = -(\kappa_\lambda + \sigma_{s,\lambda}) I_\lambda + \kappa_\lambda I_{b,\lambda} + \frac{\sigma_{s,\lambda}}{4\pi} \int_{4\pi} \phi I_\lambda(\Omega)\, d\Omega$$

The first term of the above equation represents the spatial distribution of the radiant intensity, I, and the subscript λ is to designate that each quantity in the RTE is taken as a function of the wavelength. The variables κ and θ represent the medium absorption and extinction coefficients. μ, ξ, and η are the directional cosines that describe the direction of the radiant intensity. ϕ is the scattering phase function which is equal to 1 in isotropic scattering. By numerically solving the above RTE equation, one can find the radiant intensity, I, at any point, wavelength, and direction in the enclosed area. This approach does not require calculation of view factor which is cumbersome in some cases. The above RTE does not have an analytical solution for most cases because of the complicated directional and spectral nature of thermal radiation exchange between solid objects of various complex 3D shapes.

The Monte Carlo approach was used to solve the above equation numerically. This approach uses computational mesh cells containing faces approximating the radiative surfaces. The cells are joined in clusters by a special procedure that takes into account the face area and the angles between the normal to the surface and the face in each partial cell. The cells intersected by boundaries between radiative surfaces of different emissivity are considered as belonging to one of these surfaces and cannot be combined in one cluster. The Monte-Carlo approach has been used in the CFD flow simulation to reduce computational time and minimize the computer memory requirements.

After trial and error, an environmental temperature of 85° F. and an ambient temperature of 68° F. were adopted. The environmental temperature is an approximate value of the average wall temperature surrounding the tube reflector-assembly. Emissivities for different tubes, sensor and reflector material were also determined. The first two tube sections, each 10 feet in length, were assumed to act as black bodies and thus to have an emittance of 1. The emittance of the third and fourth tube sections was assumed to be 0.94 and the emittance of the last three tube sections was taken as 0.76. The total sensor area was split into three parts A, B and C with part A having the same emissivity as the first two tube sections, part B having the emissivity of the third and fourth tube sections and part C having the emissivity of the last three tube sections. These settings were determined by trial and error. Metallic surfaces have higher emittance at higher temperatures than at lower temperatures. There is a steep temperature gradient along the 70 foot radiant tube heater used in carrying out the present method, the temperature decreasing from a peak of 1,150° F. in the first tube section to only 300° F. approximately at the last 10 foot tube section. The first two tube sections, each 10 feet in length, have the highest emittance due to the radiant tube having the highest tube temperature along this portion, while the last three tube sections exhibit the lowest emittance due to their relatively low tube temperature. As indicated, the third and fourth tubes have an emittance of 0.94, which falls between 1 and 0.76.

The emittance of the aluminized steel that was used to carry out the heat flux measurements was taken as 0.09 and the source temperature for the burner was estimated to be around 220° F. The effect of solar radiation was excluded because the heat flux measurements, according to the present method, were taken in an area where the windows were covered by shutters. It was also assumed that the environment did not scatter or absorb thermal radiation from the RTH which is a valid assumption if the atmosphere is not very humid. Using these assumptions, the above equation was reduced to the following:

$$\frac{\mu \partial I_\lambda}{\partial x} + \frac{\xi \partial I_\lambda}{\partial y} + \frac{\eta \partial I_\lambda}{\partial z} = 0$$

Symmetry was used in the computational domain dividing it into two equal parts. The actual heat flux measurement results using the above described method showed that the maximum heat fluxes moved symmetrically to the two edges of the measurement plane having a width of 65 inches. This was translated in the software by taking into account in the calculations the two outermost sloping surfaces of the reflector 10 as shown in FIG. 1, and treating them as relatively specular surfaces, which is a valid assumption for optical or almost smooth surfaces where the surface roughness is very small compared to the wavelength of the electromagnetic wave. At a low temperature, most objects emit electromagnetic thermal radiation in a long infrared wave length. As the two sloping surfaces of the reflector are at relatively low temperatures compared to those of the flat top surface of the reflector located above the radiant tube, one can assume that the roughness of the sloping surfaces is not sensitive compared to the long infrared wavelength emitted. Thus, the corresponding reflection at these surfaces is much more specular than diffuse. Therefore, in the software simulation, the specular reflection condition of emissivity was considered to be 0.09 for the sloping sides of the reflector.

Theoretical heat flux measurements using the above mentioned interpolation functions developed by CFD software were determined and are set out in Table 1 below. This table sets out the theoretical heat flux measurements for a radiant tube heater located 100 inches above the floor area and the table provides maximum, average and minimum measurements. The assumed firing rate for the burner for these calculations was 200 K and the transverse coverage area was set at 25 feet. The indicated heat flux amounts are for part A of the total sensor area, this part corresponding to the floor area below the first two tube sections (each assumed to be 10 feet in length).

TABLE 1

| 200K, 25 FT COVERAGE BASED ON 6400 POINTS | | | | | | | | | | |
|---|---|---|---|---|---|---|---|---|---|---|
| Height | Heat Flux ($W/m^2$) | Existing reflector | 140 degrees | 160 degrees | 180 degrees | 120 degrees | 100 degrees | 80 degrees | 60 degrees | 30 degrees |
| 100" | Maximum | 760 | 871 | 904 | 898 | 896 | 922 | 938 | 1001 | 982 |
| 100" | Average | 214 | 460 | 460 | 458 | 423 | 468 | 446 | 473 | 456 |
| 100" | Minimum | 47 | 57 | 57 | 57 | 81 | 57 | 58 | 91 | 57 |

Figure 9:
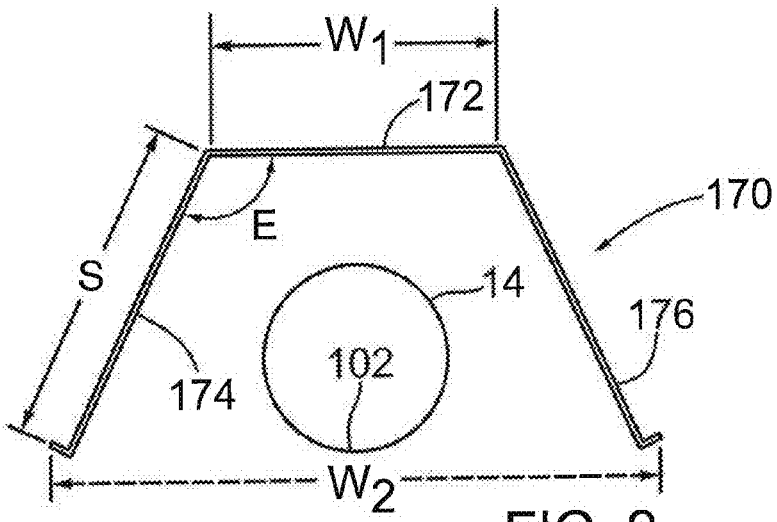
FIG. 9 PRIOR ART
FIG. 9 is a vertical cross-section of a prior art radiant tube heater and reflector.

The existing reflector results in Table 1 assume a reflector shape as shown in FIG. 9, this Figure illustrating an existing prior art reflector. This reflector has a flat, horizontally extending central portion 172 and two downwardly extending longitudinal side portions 174, 176. The angle E between each side portion and the central portion is approximately 115 degrees and the transverse width of the central portion 172 indicated at $W_1$ is about 6 inches. The complete transverse width of this known reflector indicated at $W_2$ is about 13 inches and the transverse width of each side portion indicated at S is about 6.8 inches. The diameter of the radiant tube 14 is set at about 4 inches which is the standard diameter and it is assumed that the bottom extremity 102 of the radiant tube is aligned approximately in the horizontal direction with the two bottom edges of the reflector.

Figure 10:
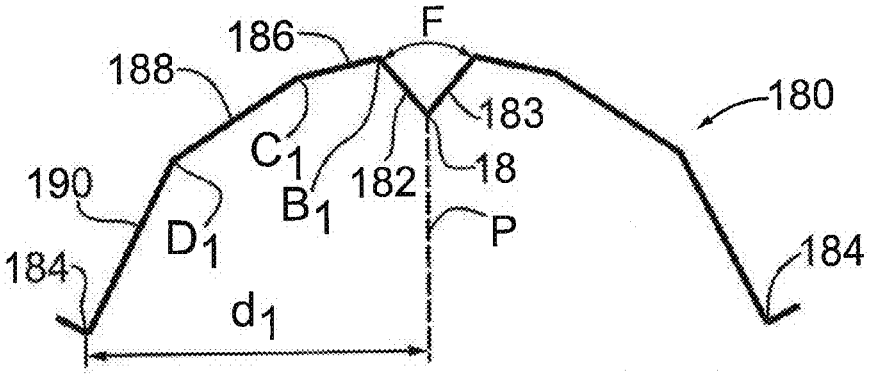
FIG. 10 is a vertical cross-section of an inner reflector having a central, outwardly facing angle of 80 degrees.

In addition to this existing reflector configuration, Table 1 shows the numerical calculated heat flux measurements for various reflectors with different outer central angles, these reflectors having multiple bends on both sides of their center line. The calculated results are shown for reflectors having a central outer angle of 140, 160, 180, 120, 100, 80, 60, and 30. It will be seen from Table 1 that the calculated maximum heat fluxes for reflectors having a center angle ranging between and including 30 degrees and 80 degrees are substantially higher than the maximum heat flux reading for the existing prior art reflector having a maximum calculated heat flux of 760. The highest calculated maximum heat flux reading is for a reflector having a center angle of 60 degrees wherein the calculated heat flux is at least 1001. FIG. 10 illustrates a reflector 180 with an outer central angle located at F of 80 degrees and it is this reflector having multiple bends that is used for purposes of the calculations for the 80 degrees reflector shown in Table 1.

The angle F is formed by two central panel portions 182, 183 which meet at the centerline 18 of the reflector. FIG. 10, which is drawn to scale, indicates the distance $d_1$ which extends from one of the two bottom edges 184 of the reflector to a central, longitudinal vertical plane P that extends through the centerline 18. The distance $d_1$ in this reflector 180 is 7.13 inches. Extending outwardly from each central panel portion 182, 183 is a second longitudinal panel portion 186, a third panel portion 188, and a fourth panel portion 190. The obtuse inner angle $B_1$ measures approximately 117 degrees while the obtuse inner angle $C_1$ measures 160 degrees. The angle $D_1$ between the third panel portion 188 and the fourth panel portion 190 measures 150 degrees. The widths of the first, second, third and fourth panel portions are respectively 1.43, 1.76, 2.97 and 3.90 inches.

Figure 11:
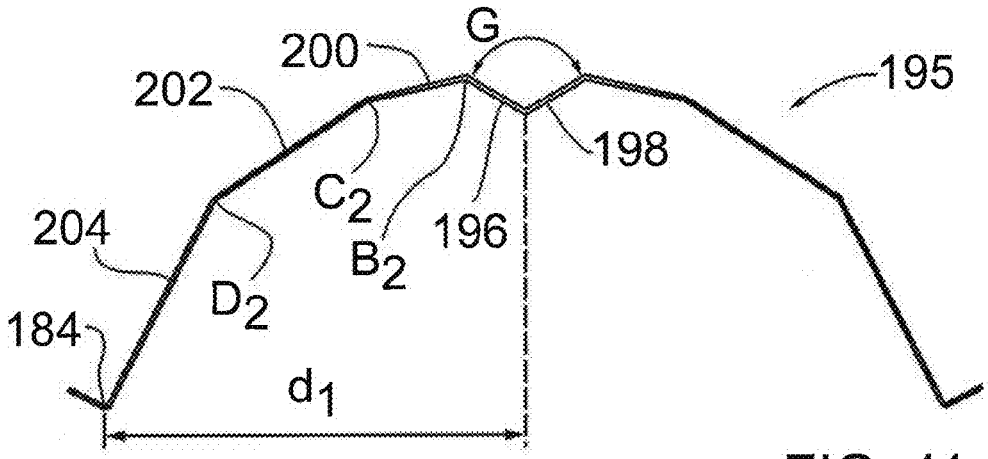
FIG. 11 is a vertical cross-section of an inner reflector having a central, outwardly facing angle of 120 degrees.

FIG. 11 illustrates a simulated reflector 195 on which CFD software was used to provide the calculated heat flux measurements set forth above in Table 1 for an angle of 120 degrees. The computer calculations were based on the reflector 195 having an outwardly facing central angle G measuring 120 degrees. This central angle is defined by two central panel portions 196 and 198, each having a transverse width of 1.46 inches. As in the embodiment of FIG. 10, extending outwardly and downwardly from each of the central panel portions are three longitudinal reflecting portions indicated at 200, 202 and 204. An internal, obtuse angle is formed between the central panel portion 196 and the reflecting portion 200, this angle being indicated at $B_2$. The angle $B_2$ is set at 135 degrees. A further inwardly facing obtuse angle $C_2$ is formed between the reflecting portions 200 and 202 and this angle is set at 160 degrees. A further inwardly facing, obtuse angle is formed between the reflecting portions 202 and 204, this angle indicated at $D_2$. This angle is set at 150 degrees. The distance $d_1$ in the reflector of FIG. 11 is the same distance as in the reflector 180 of FIG. 10. The central panel portion 196, 198 have a transverse width of 1.46 inches while the reflecting portions 200, 202 and 204 have transverse widths of 1.78, 2.72 and 3.90 inches respectively for the CFD calculations.

Figure 12:
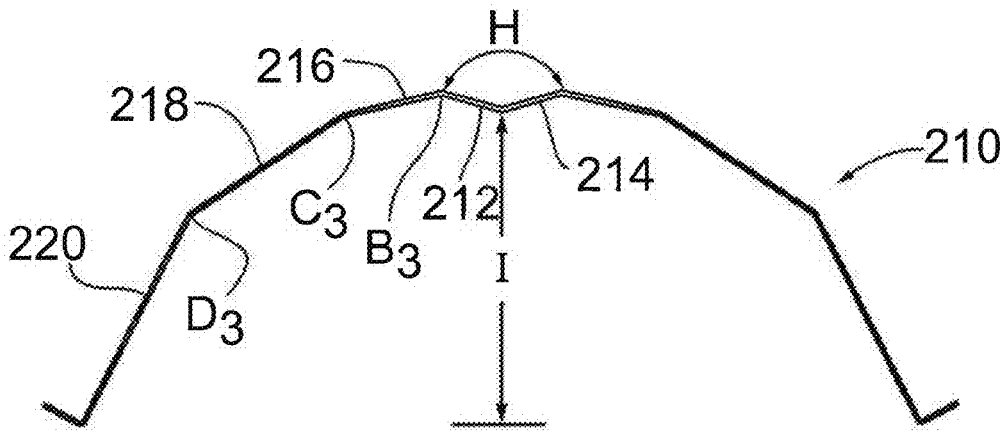
FIG. 12 is a vertical cross-section of an inner reflector having a central, outwardly facing angle of 160 degrees.

Turning to the simulated metal reflector illustrated in FIG. 12, this reflector 210 has a central, outwardly facing angle H measuring 160 degrees. The maximum heat flux readings for this reflector were also determined by the CFD software and the results of these calculations are indicated in the 160 degree column of Table 1. Again the central angle H is formed by two central panel portions 212 and 214. As in the reflectors 180 and 195, there are longitudinally extending reflecting portions 216, 218 and 220 extending outwardly and downwardly from each of the central panel portions. The inwardly facing, obtuse angle between the central panel portion 212 and the reflecting portion 216 is set at about 155 degrees while the angle $C_3$ between the longitudinal reflecting portions 216, 218 is set at 160 degrees, the same as the angle $C_2$. The inner obtuse angle $D_3$ formed between the reflecting portions 218 and 220 is set at 150 degrees, the same as the angle $D_2$ of the reflector 195. The transverse width of the two central panel portions 212 and 214 is 1.48 inches while the transverse widths of reflecting portions 216, 218 and 220 are 1.80, 2.60, and 3.90 inches respectively. The central internal height indicated at I in FIG. 12 is greater than the corresponding dimension of the reflector 195 and is 5.35 inches.

Figure 13:
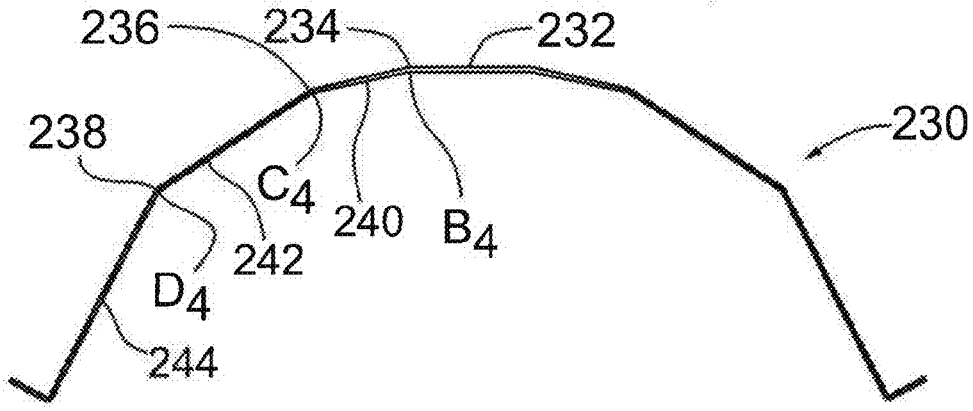
FIG. 13 is a vertical cross-section of an inner reflector having a flat central panel section and no central angle.

Turning now to the simulated reflector 230 illustrated in FIG. 13, this reflector has no center angle located at the transverse midpoint of the reflector and corresponds to the "180 degrees" reflector referred to in Table 1. This reflector has a flat central panel portion 232 which has a set width of 2.97 inches. Three longitudinal bends are provided in this simulated reflector between the center of the panel portion 232 and each of the two bottom edges of the reflector, these bends being indicated at 234, 236, and 238. The inwardly facing, obtuse angle indicated at $B_4$, $C_4$ and $D_4$ are approximately 165 degrees, 160 degrees, and 150 degrees respectively. The angle $C_4$ is the same as the angle $C_3$ of the reflector 210 and the angle $D_4$ is the same as the angle $D_3$. The widths of the three longitudinal reflecting portions indicated at 240, 242 and 244 are approximately the same as the widths of the corresponding longitudinal reflecting portions of the reflector 210.

Table 2 below shows the calculated numerical heat flux measurements for various reflectors positioned at three different heights above the floor, namely 100 inches, 14 feet and 18 feet. Calculated measurements are shown for maximum, minimum and average heat flux measurements. The column entitled Existing Reflector is based on a reflector design such as that shown in FIG. 9 which is a reflector according to the prior art. The remaining columns show the measurements for various reflectors having an outer central angle according to that indicated at the top of the column. Thus measurements are shown for reflectors having a central angle of 140, 160, 180, 120, 100, 80, 60, 45 and 30 degrees. These calculated results show that a very good maximum heat flux level can be obtained with the center angle ranging from 30 degrees to 80 degrees with the highest maximum heat flux being achieved with a center angle of about 45 degrees. It can also be seen from Table 2 that heat levels decrease as the height of the radiant tube heater is increased. As in Table 1, Table 2 assumes that the radiant tube heater has a firing rate of 200 k and the transverse width of the coverage area is 25 feet.

firing rate of 200 BTU/FT$^2$ is desirable for a radiant tube heater located 100 inches or more above floor level.

As is well understood in the art, radiant tube heaters can be installed at different heights in a building depending upon the heating requirements and the height of the ceiling in the building. The actual heat flux measurements that were conducted using the above described equipment were conducted at a height of 100 inches. The 100 inch height is indicated in the schematic drawing of FIG. 7 at H1 while the 14 feet height is indicated at H2 and the 18 feet height is indicated at H3. Only CFD software results for heat flux levels were calculated for radiant tube heights of 14 feet and 18 feet. The floor area is indicated at 120 in FIG. 7 while adjacent walls on opposite sides of the radiant tube heater are illustrated at 160 and 162. As is understood by those skilled in the construction of radiant tube heaters and their reflectors, the reflector acts to focus the radiant heat energy to a significant extent, this focus being indicated by the arrows F on the left side of the Figure.

TABLE 2

200K, 25 ST coverage based on 3600 points

| Height | Heat Flux (W/m$^2$) | Existing Reflector | 140 degrees | 160 degrees | 180 degrees | 120 degrees | 100 degrees | 80 degrees | 60 degrees | 45 degrees | 30 degrees |
|---|---|---|---|---|---|---|---|---|---|---|---|
| 100" | Maximum | 750/765 | 887/911 | 880/908 | 888/895 | 865/892 | 914/924 | 941/948 | 941/975 | 967/1015, 964/1012 | 960/990 |
| | Average | 758 | 900 | 894 | 891 | 879 | 919 | 945 | 960 | 990 | 975 |
| | Maximum of the above two: Excel and surface parameters | | | | | | | | | | |
| 100" | Minimum | 47 | 34 | 43 | 44 | 44 | 43 | 43 | 44 | 43 | 43 |
| 100" | Average | 214 | 244/245 | 239/242 | 240/242 | 224/223 | 247/250 | 235/238 | 245/246 | 244/246 | 228/233 |
| 100" | Average of the above two: Excel and surface parameters | 214 | 245 | 240.5 | 241 | 224 | 249 | 237 | 246 | 245 | 230 |
| 14 Ft | Maximum | | 448/467 | 451/466 | 445/452 | 422/437 | 455/468 | 481/509 | 485/527 | 500/531 | 489/513 |
| 14 Ft | Average | | 459 | 459 | 448 | 430 | 462 | 497 | 507 | 516 | 501 |
| | Maximum of the above two: Excel and surface parameters | | | | | | | | | | |
| 14 Ft | Minimum | | 36 | 43 | 50 | 46 | 50 | 48 | 46 | 43 | 47 |
| 14 Ft | Average | | 190/191 | 184/186 | 189/199 | 175/175 | 194/194 | 191/193 | 196/196 | 195/195 | 191/192 |
| | Maximum of the above two: Excel and surface parameters | | | | | | | | | | |
| 14 Ft | Average | | 191 | 185 | 194 | 175 | 194 | 192 | 196 | 195 | 191 |
| 18 Ft | Maximum | | 322/328 | 330/347 | 323/328 | 305/314 | 332/339 | 349/363 | 343/382 | 349/365 | 365/386 |
| 18 Ft | Average | | 325 | 339 | 325 | 310 | 336 | 356 | 364 | 357 | 375 |
| | Maximum of the above two: Excel and surface parameters | | | | | | | | | | |
| 18 Ft | Minimum | | 39 | 43 | 50 | 43 | 43 | 43 | 48 | 43 | 43 |
| 18 Ft | Average | | 159/160 | 159/161 | 160/160 | 148/148 | 164/165 | 164/165 | 167/167 | 166/167 | 165/166 |
| 18 Ft | Average | | 160 | 160 | 160 | 148 | 165 | 165 | 167 | 167 | |
| | Maximum of the above two: Excel and surface parameters | | | | | | | | | | |

In the case of a burner having a low firing rate, such as 60,000 BTU/H, the average heat flux significantly decreased to 176 BTU/FT$^2$ which is below an acceptable heating level for most heater applications. Therefore, a burner having a The focus is determined by the shape and orientation of the reflector and in particular the slope of the side walls of the reflector as well as the width of the reflector. The arrows D in FIG. 7 represent dispersed radiant heat energy that extends over a larger area and that comes from both being reflected off the inner surface of the reflector and from the radiant tube itself.

Figure 7:
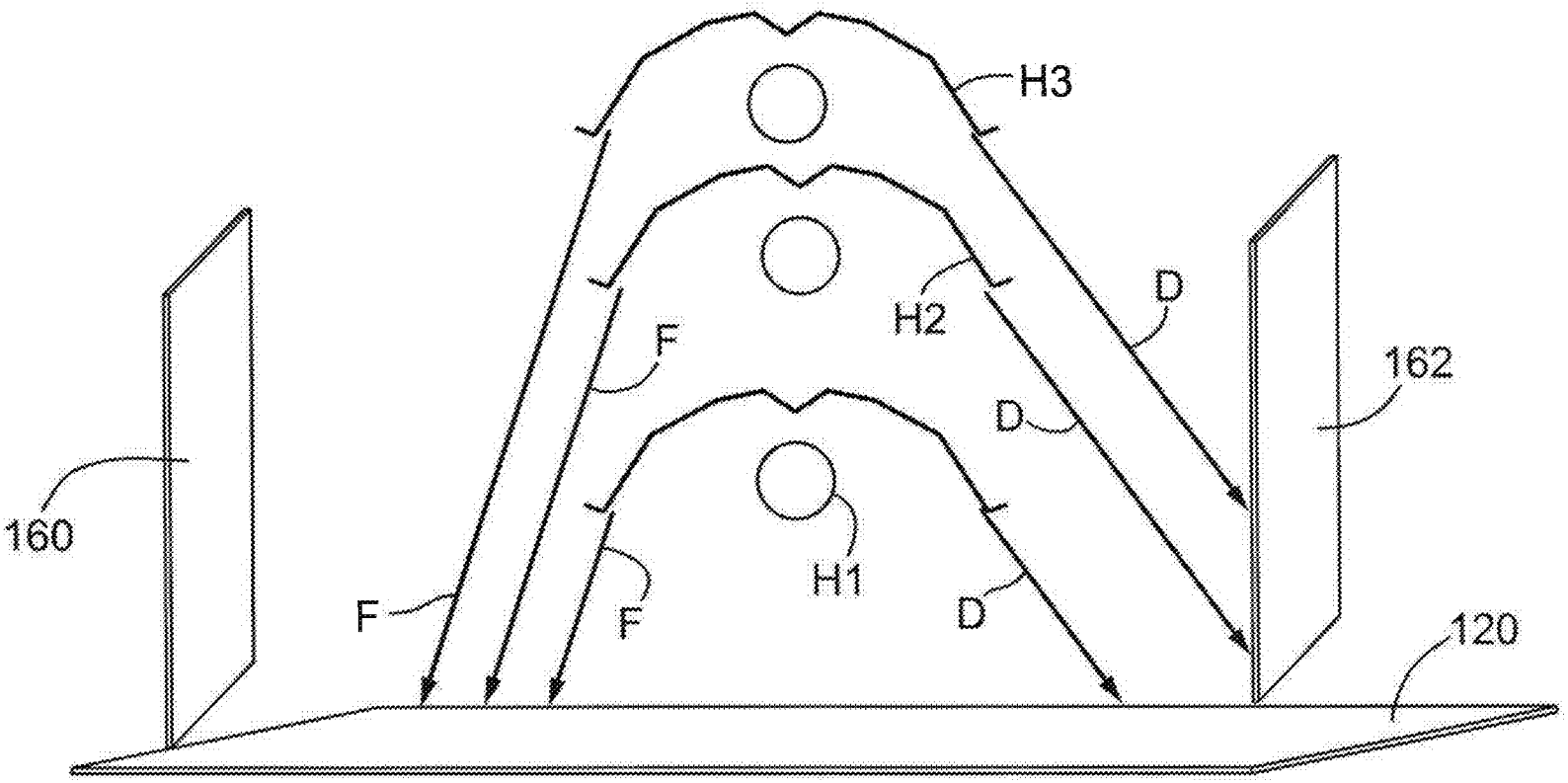
FIG. 7 is a schematic illustration illustrating how heat flux readings were taken at different heights from the floor for determining maximum and minimum heat flux readings over the floor area.

Generally speaking, the radiant tube energy which strikes a wall such as the wall 162 on the right side of FIG. 7 constitutes wasted heat and it is known to locate radiant tube heaters so as to avoid heat being wasted in this manner.

The improved reflector construction in accordance with the present disclosure represents a substantial improvement over known reflectors for radiant heating tubes. The use of the improved present reflectors can result in substantial savings of heating costs and indirectly can reduce the emission of greenhouse gases created by the operation of radiant tube heaters. Moreover the present reflectors can be manufactured at little or no additional costs compared to known reflectors for such heaters.

The CFD calculations described above verified the actual heat flux readings. The tube temperature measurements taken at the steady state acted and served as boundary conditions for the assimilation code. The correlation between the experimental data measurements and the generated CFD values is between 97 and 98% which establishes the validity of the testing procedures described above.

Figure 14:
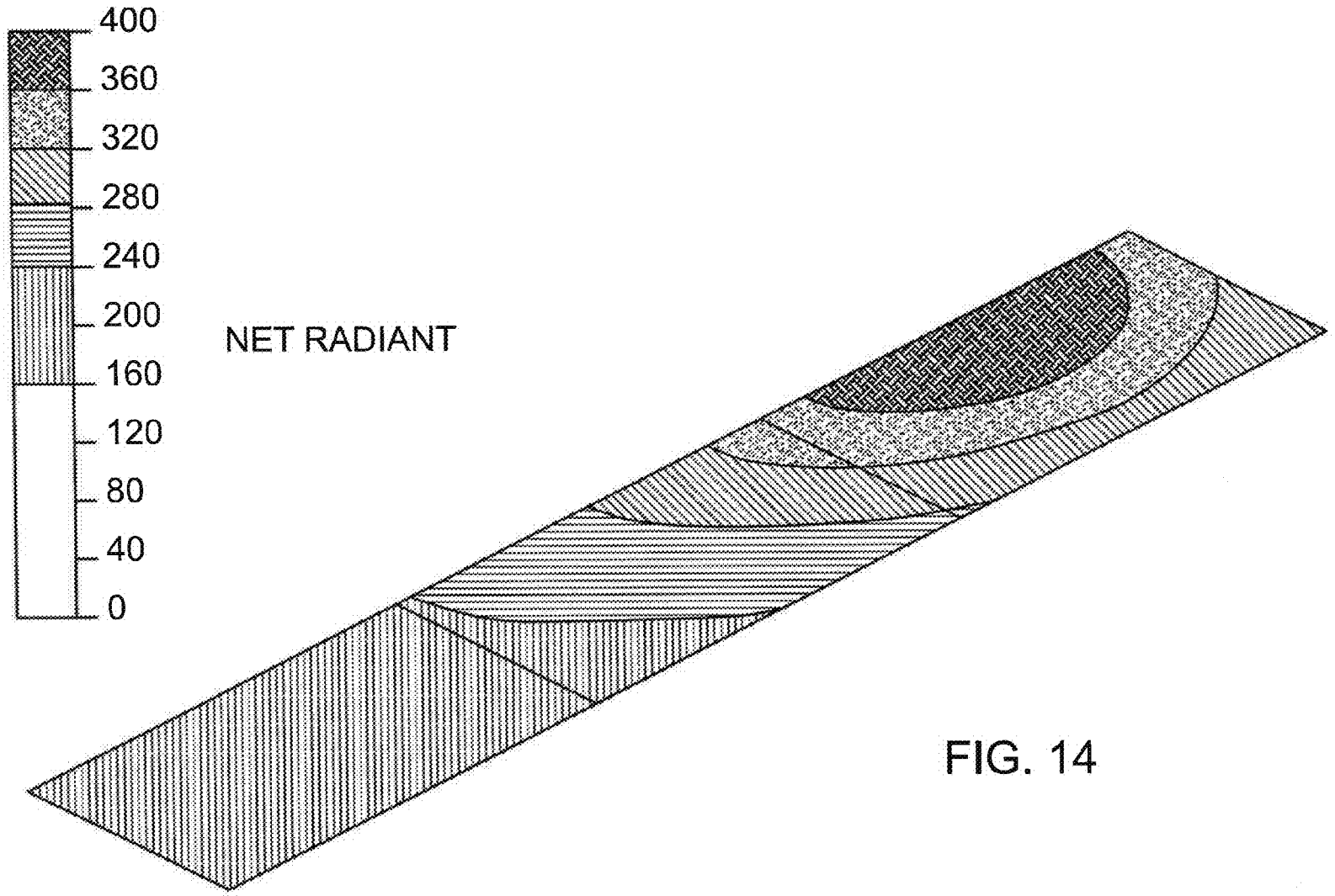
FIG. 14 is a graphical depiction of heat flux readings taken using the reflector of FIG. 1, the height of the radiant tube being 18 feet above floor.
Figure 15:
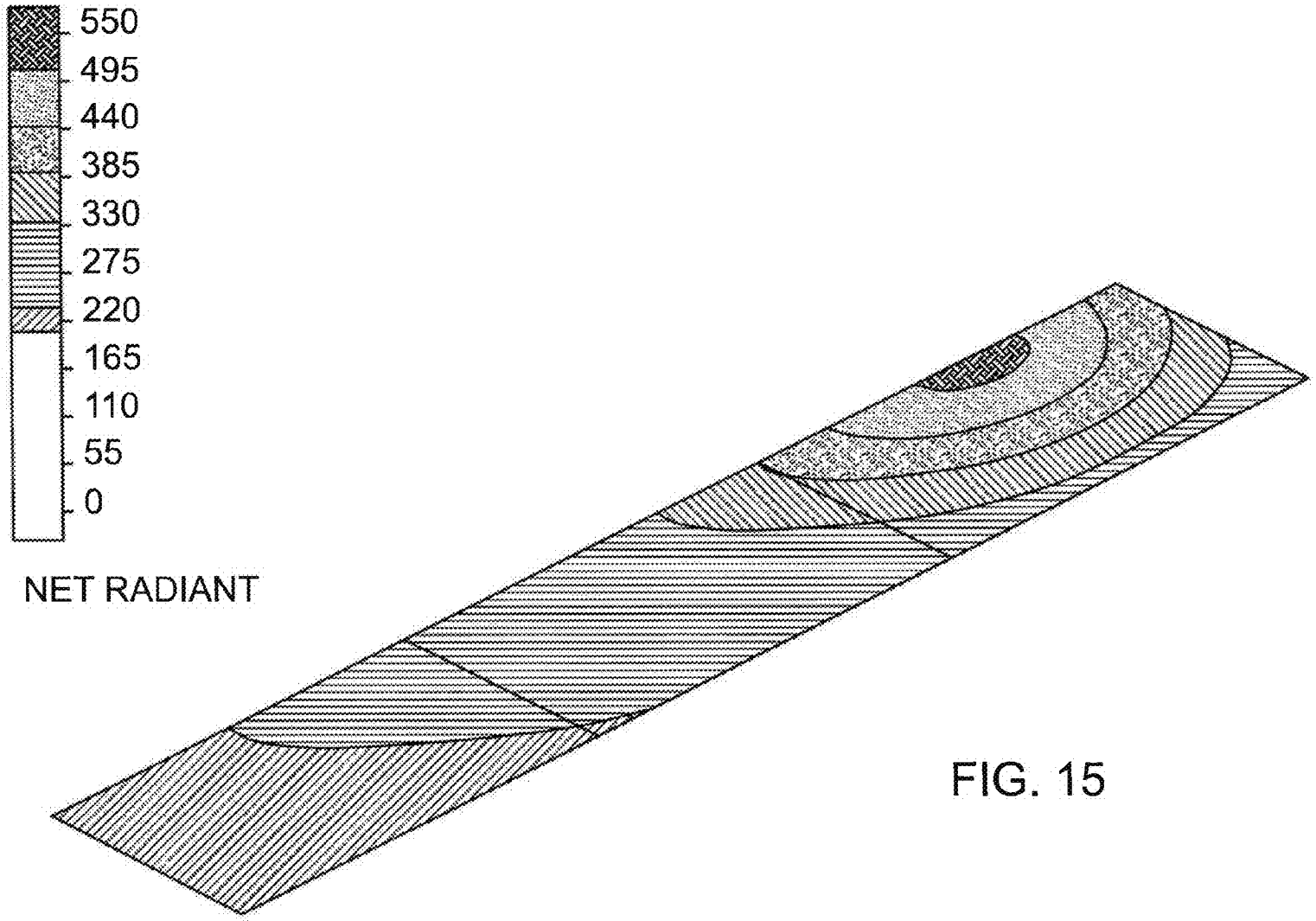
FIG. 15 is a graphical depiction of heat flux readings taken using the reflector of FIG. 1, the height of the radiant tube being 14 feet above floor.

Shown in the computer drawings of FIGS. 14 and 15 are graphical depictions of the net radiant heat flux readings along three sections of a radiant tube heater using the CFD heat flux calculations. In FIG. 14 there is shown the heat flux readings for a radiant tube heater located at 18 feet above the floor and having a coverage area of 25 feet measured transversely of the radiant tube. Shown in FIG. 15 is a graphical depiction of the net radiant heat flux readings for the same radiant tube heater with the height of 14 feet above the floor. Both depictions clearly show that the maximum reading in each case is located just downstream from the burner end of the radiant tube as expected and the readings become gradually lower further down the tube from the burner. Both figures depict the measurements when the reflector was constructed in the manner illustrated in FIG. 1, that is, with an outer central angle of 100 degrees.

While the present invention has been illustrated and described as embodied in various exemplary embodiments, e.g., embodiments having particular utility in radiant heating applications, it is to be understood that the present invention is not limited to the details showed herein, since it will be understood that various omissions, modifications, substitutions and changes in the forms and details of the disclosed systems and reflectors can be made by those skilled in the art without departing in any way from the scope of the present invention. For example those of ordinary skill in the art will readily adapt the present disclosure for various other applications without departing from the scope of the present invention.

We claim:

1. A radiant tube heater system for heating a covered space in a building or similar structure comprising:

a single tubular cylindrical conduit through which hot fluid including combustion gases flow from one end to another end of the conduit;

a plurality of support structures for supporting the conduit at spaced locations along its length;

an insulated reflector extending lengthwise along said tubular conduit and constructed and shaped to reflect and disperse radiant heat waves from the conduit, said reflector having a first longitudinal centerline located above a second longitudinal centerline of said conduit, said first longitudinal centerline defining two similar half sections extending in opposite transverse directions from said first longitudinal centerline, each half section including a respective generally planar central portion that slopes upwardly from said first longitudinal centerline during use of the heater system, a second generally planar reflecting portion adjacent to the central portion, a third generally planar reflection portion adjacent to the second portion and a fourth generally planar reflecting portion adjacent to the third portion, the portions being disposed in angled relation to one another such that the central portions define an outwardly facing angle of about 100°, the second portions are disposed at about 126° to the central portions, the third portions are disposed at about 160° to the second portions and the fourth portions are disposed at about 150° to the third portions, and wherein D:D1:D2:D3:D4:D5 is about 40:15:18:28:40:29

D is the outer diameter of the conduit

D1 is the distance between the first longitudinal centreline and the junction of the central portion and the second portion D2 is the distance between the junction of the central portion and the second portion and the junction of the second portion and the third portion D3 is the distance between the junction of the second portion and the third portion and the junction of the third portion and the fourth portion D4 is the distance between the junction of the third portion and the fourth portion and the terminus of the fourth portion D5 is the distance between the axis of the conduit and the first longitudinal centreline said tubular conduit extends approximately horizontally during use of the heater system and has lower and upper longitudinal extremities in the horizontal position, said lowermost extremity being aligned with two opposite bottom edges of the reflector and said upper extremity being less than one inch from said first longitudinal centerline;

said reflector is made of polished aluminized steel sheet metal or polished Feran; and said reflector is insulated with a layer of ceramic insulation extending over said outer surface.

2. A tube heater system according to claim 1 wherein said tubular conduit has an exterior diameter of about 4 inches and said reflector has an open bottom with horizontal width in the range of 12 to 15 inches.

3. A tube heater system according to claim 2 wherein said tubular conduit has a length of at least 30 feet and a gas burner is attached to an upstream end of the tubular conduit, said burner having a firing rate between about 45,000 BTU/hour and 200,000 BTU/hour.

* * * * *